US006267089B1

(12) United States Patent
Golovatai-Schmidt

(10) Patent No.: US 6,267,089 B1
(45) Date of Patent: Jul. 31, 2001

(54) APPLIANCE FOR MODIFYING THE TIMING OF GAS-EXCHANGE VALVES OF AN INTERNAL COMBUSTION ENGINE, IN PARTICULAR HYDRAULIC CAMSHAFT ADJUSTMENT DEVICE OF ROTARY PISTON TYPE

(75) Inventor: Eduard Golovatai-Schmidt, Röttenbach (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/563,216

(22) Filed: May 2, 2000

Related U.S. Application Data

(60) Provisional application No. 60/155,946, filed on Sep. 24, 1999.

(51) Int. Cl.[7] ..... F01L 1/344

(52) U.S. Cl. ..... 123/90.17; 123/90.37

(58) Field of Search ..... 123/90.15, 90.17, 123/90.31, 90.33, 90.37; 74/568 R; 464/1, 2, 160

(56) References Cited

U.S. PATENT DOCUMENTS 5,520,145 * 5/1996 Nagai et al. ..... 123/90.17
5,813,378 * 9/1998 Sato ..... 123/90.17
5,937,810 * 8/1999 Sato et al. ..... 123/90.17

* cited by examiner

*Primary Examiner*—Weilun Lo
(74) *Attorney, Agent, or Firm*—Bierman, Muserlian and Lucas

(57) ABSTRACT

The invention relates to a hydraulic camshaft adjustment device of rotary piston type, which consists of a driving wheel in drive Connection with a crankshaft and of an impeller which is torsionally connected to a camshaft. The driving wheel has a hollow space formed by a peripheral wall and two side walls, at least one hydraulic working space being formed, in this hollow space by at least two boundary walls. The impeller has at least one radial vane (13) and with each vane (13), subdivides a hydraulic working space into two hydraulic pressure chambers. In this arrangement, the outer end surface of each vane (13) of the impeller is in sealing con tact with the peripheral wall of the driving wheel by means of a spring element. In accordance with the invention, the vanes (13) of the impeller are additionally configured with balance ducts (19, 20) with which, during pressurization of one or both pressure chambers of each hydraulic working space of the appliance, the hydraulic fluid pressure in the pressurized pressure chambers, which acts on the outer end surf ace (18) of the vanes, (13) can also be transmitted to the inner end surface (16) of the vanes (13).

6 Claims, 2 Drawing Sheets

APPLIANCE FOR MODIFYING THE TIMING OF GAS-EXCHANGE VALVES OF AN INTERNAL COMBUSTION ENGINE, IN PARTICULAR HYDRAULIC CAMSHAFT ADJUSTMENT DEVICE OF ROTARY PISTON TYPE

This application claims benefit of application Ser. No. 60/155,946 filed Sep. 24, 1999.

Appliance for modifying the timing of gas-exchange valves of an internal combustion engine, in particular hydraulic camshaft adjustment device of rotary piston type.

1. Field of the Invention

The invention relates to an appliance for modifying the timing of gas-exchange valves of an internal combustion engine comprising a driving wheel (2) which is configured as an external rotor, which is in drive connection with a crankshaft of the internal combustion engine and has a hollow space (6) formed by a hollow-cylindrical peripheral wall (3) and two side walls (4, 5), at least one hydraulic working space (8) is formed in the hollow space (6) of the driving wheel (2) by at least two boundary walls (7) extending from the inside of the peripheral wall (3) and directed toward the longitudinal center line of the driving wheel (2), an impeller (10) which is configured as an internal rotor, is torsionally connected to a camshaft (9) of the internal combustion engine and is inserted in the hollow space (6) of the driving wheel (2), on the periphery of an impeller hub (11), the impeller (10) has at least one vane (13) which is arranged in an axial retention groove (12) and which extends radially in a working space (8) of the driving wheel (2) and subdivides each working space (8) into two oppositely acting hydraulic pressure chambers (14, 15), the outer end surf ace (18) of each vane (13) of the impeller (10) is in sealing contact with the inside of the peripheral wall (3) of the driving of the driving wheel (2) due to the force of a spring element (17) arranged an the inner end surface (16) of the vane in the axial retention groove (12), during optional or simultaneous pressurization by means of a hydraulic fluid, the pressure chambers (14, 15) cause a pivoting motion or fixed location of the impeller (10) relative to the driving wheel (2) and, therefore, of the camshaft (9) relative to the crankshaft, and it can be realized in a particularly advantageous manner on hydraulic camshaft adjustment devices of rotary piston type.

2. Background of the Invention

Such an appliance, is already known from EP 818 610 A2, which forms the generic type. This appliance, configured as a so-called vane-cell adjustment device, consists of a driving wheel configured as an external rotor and of an impeller configured as an internal rotor, in this arrangement the driving wheel is in drive connection with a crankshaft of the internal combustion engine whereas the impeller is torsionally connected to a camshaft of the internal combustion engine. In addition, the driving wheel has a hollow space formed by a hollow-cylindrical peripheral wall and two side walls and in which five hydraulic working spaces are formed by five boundary walls extending from the inside of the peripheral wall and directed toward the longitudinal center line of the appliance. The impeller is inserted in the hallow space of the driving wheel and has, in turn, five vanes Arranged in an axial retention groove on the periphery of its impeller hub, each of these vanes extending radially in a working space of the driving wheel. In this arrangement the outer end surfaces of the vanes are in sealing contact with the inside of the peripheral wall of the driving wheel due to the force of a spring element arranged on each inner end surface of the vanes in the axial retention groove and, by this means, subdivide each hydraulic working space of the driving wheel into two oppositely acting hydraulic pressure chambers. During optional or simultaneous pressurization by means of a hydraulic fluid, these pressure chambers cause a pivoting motion or hydraulic clamping of the impeller relative to the driving wheel and, therefore, a relative rotation or fixed location of the camshaft relative to the crankshaft.

A disadvantageous feature of this known appliance is that during pressurization of one or both pressure chamber(s) of each hydraulic working space, a build-up of pressure occurs in the sealing gap between the outer end surface of the vane and the inside of the peripheral wall of the driving wheel in addition to the build-up of pressure which occurs in the axial retention groove of the vanes or on their inner end surface. The pressure acting on the outer end surface of the vane, and therefore causing a centripetal force, then corresponds to the pressure of the respectively pressurized pressure chamber and is, in each case, higher than the pressure acting on the inner end surface of the vane, and therefore causing a centrifugal force, because the latter pressure is throttled in an uncontrolled manner by the usually very narrow sealing gape between the vanes and their retention grooved and because of the depth of these retention grooved. If the centripetal force acting on the vanes then exceeds the sum of the spring force of the spring elements and the centrifugal force acting on the vanes, a so-called "vane immersion" can occur, i.e. a radial displacement of the vanes against the force of their spring elements. This, in turn, causes increased hydraulic fluid leakage between the individual pressure sure chambers of the hydraulic working spaces, so that the hydraulic clamping of the impeller relative to the driving wheal is impaired. In addition, these increased hydraulic fluid leaks are the cause of larger deviations from the specified adjustment angle between the camshaft and the crankshaft and of retarded adjustment times of the appliance.

OBJECT OF THE INVENTION

The invention is therefore based on the object of designing an appliance for modifying the timing of gas-exchange valves of an internal combustion engine, in particular hydraulic camshaft adjustment device of rotary piston type, in which the radial displacement of the vanes against the force of their spring elements, resulting from the build-up of pressure in the sealing gap between the outer end surface of each vane of the impeller and the inside of the peripheral wall of the driving wheel, is effectively avoided.

SUMMARY OF THE INVENTION

This object is achieved, in accordance with the invention, in such a way that the vanes of the impeller are additionally configured with pressure balance means with which, during pressurization of one or both pressure chamber(s) of each hydraulic working space of the appliance, the hydraulic fluid pressure in the pressurized chambers, which acts on the outer end surface of the vanes, can also be transmitted to the inner end surface of the vanes.

In expedient development of the invention, the pressure balance means on the vanes of the impeller are, in this arrangement, preferably configured as balance ducts extending in each case from the outer end surface of the vanes to their inner and surface.

As a particularly advantageous first embodiment of the balance ducts on the vanes of the impellers it is proposed that these should be configured as radial grooves which are machined into each of the two side surfaces, which are in sealing contact with the side walls of the driving wheel, of the vane. These radial, grooves arc are in further configuration of the balance ducts according to the invention, preferably arranged on the radial longitudinal center lines of the side surfaces of the vanes and have a profile cross section which is sufficiently large to permit compensation on for the hydraulic fluid leaks between the pressure chambers of each hydraulic working space, which necessarily occur through the axial retention grooves of the vanes because of manufacturing tolerances. From the point of view of manufacturing technology radial grooves which are configured with a triangular profile cross section and which have a width corresponding to approximately one third of the vane thickness and a depth corresponding to approximately one quarter of the vane thickness, have been found to be the most advantageous. It is, however, also possible to machine only one of these radial grooves in one of the side surfaces of each vane and/or also to provide them with a semicircular or quadrilateral profile cross section within the preferred dimensions.

In a likewise advantageous second embodiment of the balance ducts on the vanes of the impeller, it is proposed that these should, on the other hand, be configured as two radial holes which extend through the vanes at right angles to their end surfaces and are arranged symmetrically relative -to one another. In further configuration the balance ducts according to the invention, these radial holes are preferably arranged on the axial longitudinal center lines of the outer and surfaces of the vanes and likewise have a diameter which is sufficiently large to provide compensation for the hydraulic fluid leaks between the pressure chambers of the hydraulic working spaces occurring via the axial retention grooves of the vanes. It is then most advantageous for two radial holes in each vane to have a diameter corresponding, to approximately one quarter of the vane thickness, it being however also possible to vary the number of radial holes in each vane and to vary their diameter appropriately.

The appliance, configured according to the invention, for modifying the timing of gas-exchange valves of an internal combustion engine, in particular hydraulic camshaft adjustment device of rotary piston type, therefore has the advantage relative to the appliances known from the prior art that, due to the balance ducts (in the vanes of the impeller) extending from the outer end surfaces of the vanes to their inner end surfaces, the hydraulic fluid pressure, of the respectively pressurized pressure chambers, acting during pressurization of the pressure chambers on the outer end surfaces of the vanes is transmitted into the retention grooves of the vanes and therefore is also present at the inner end surfaces of the vanes. The result therefore, is a pressure balance between the outer and the inner end surfaces of the vanes because the centripetal and centrifugal forces acting on the vanes are now of equal magnitude and cancel each other out. A "vane immersion" or a radial displacement of the vanes against the force of their spring elements is therefore no longer possible so that the force of the spring elements is again sufficient to seal the pressure chambers of the hydraulic working spaces of the appliance relative to one another by means of the vanes of the impeller to [sic] the inside of the peripheral wall of the driving wheel.

BRIEF DESCRIPTION OF THE DRAWINGS

The invention is explained in more detail below using an embodiment example. In the associated drawings.

DETAILED DESCRIPTION OF THE DRAWINGS

Figure 2:
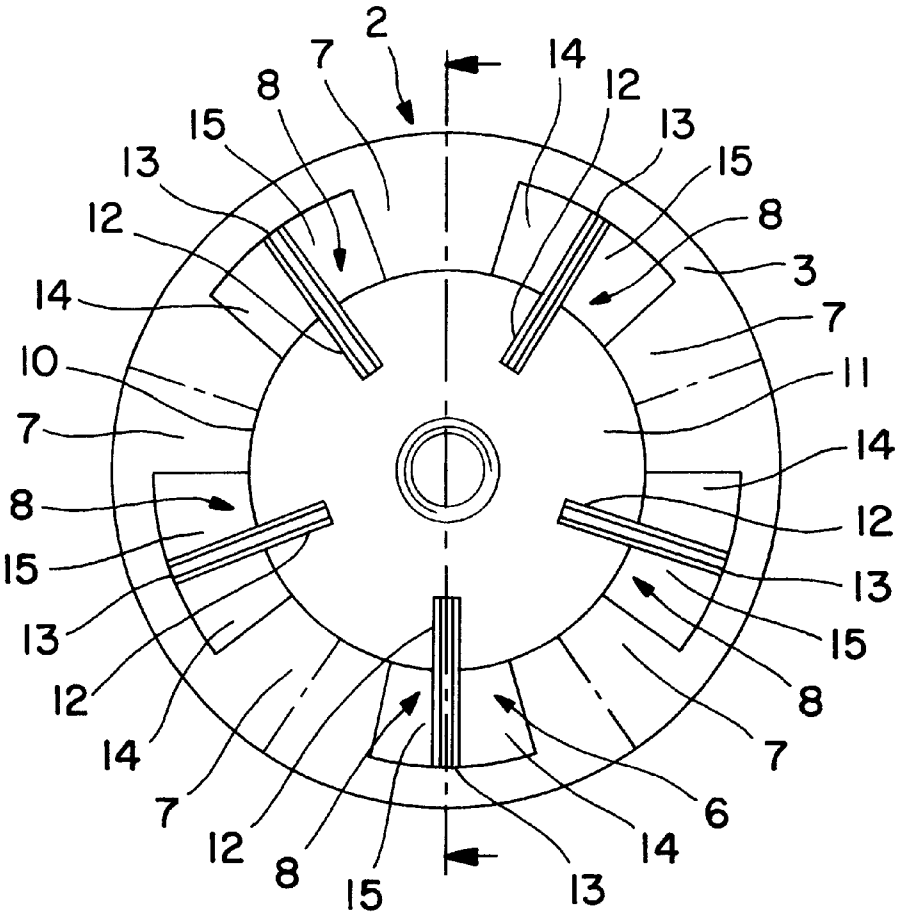
FIG. 2 shows the cross section B—B of FIG. 1 through an appliance configured in accordance With the invention.
Figure 1:
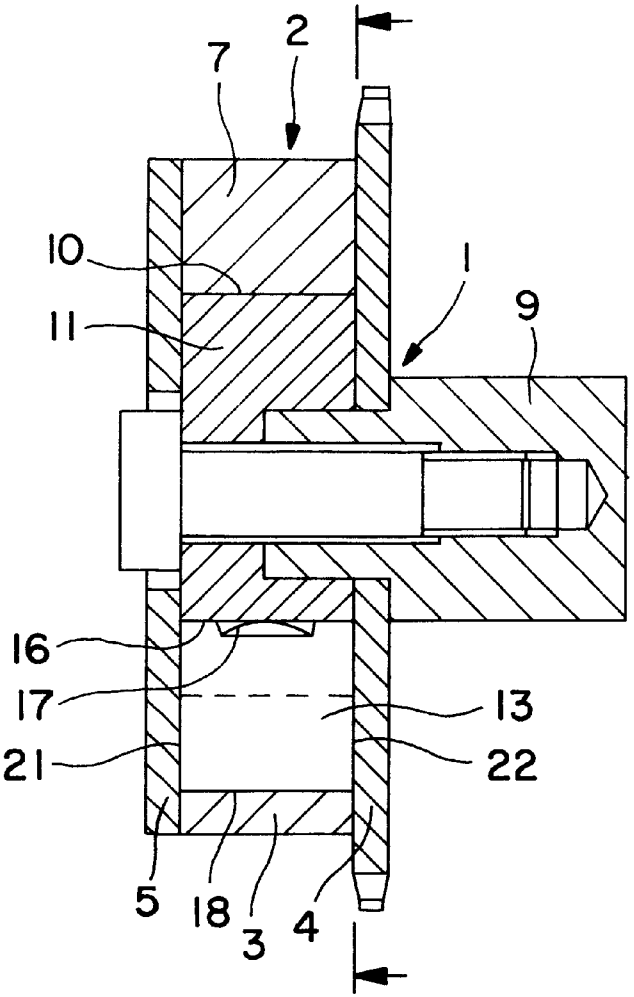
FIG. 1 shows the longitudinal section A—A of FIG. 2 through an appliance configured in accordance with the invention.

FIGS. 1 and 2 clearly show an appliance 1, which is configured as a hydraulic camshaft adjustment device of rotary piston type, for modifying the timing of gas-exchange valves of an internal combustion engine which consists of a driving wheel 2, which is configured as an external rotor and is in drive connection with a crankshaft (not shown) of the internal combustion engine, and of an impeller 10, which is configured as an internal rotor and is torsionally connected to the camshaft 9 of the internal combustion engine. In this arrangement, the driving wheel 2 has a hollow space 6, which is formed by a peripheral wall 3 and two side walls 4, 5 and in which five hydraulic working spaces 8 are formed by five boundary walls 7 which extend from the inside of the peripheral wall 3 and are directed toward the longitudinal center line of the driving wheel 2. It may also be seen from FIGS. 1 and 2 that the impeller 10 likewise has, at the periphery of its impeller hub 11, five ivy vanes 13 respectively arranged in an axial retention groove 12 and is inserted in the hollow space 6 of the driving wheel 2 in such a way that each vane 13 extends radially into a working space 8 of the driving, wheel 2 and, in each case, subdivides the working space into two oppositely acting hydraulic pressure chambers 14, 15. In this arrangement, it is clearly visible that the outer end surface 18 of each vane 13 of the impeller 10 is in sealing contact with the inside of the peripheral wall 3 of the driving wheel 2 due to the force of a spring element 17 arranged in the axial retention groove 12 at its inner end surface 16, so that, during optional or simultaneous pressurization with a hydraulic fluid, the pressure chambers 14, 15 cause a pivoting motion or fixed location of the impeller 10 relative to the driving wheel 2 and therefore of the camshaft 9 relative to the crankshaft.

In order to avoid a "vane immersion" resulting from the pressure build-up in the sealing gap between the outer end surface 16 of each vane 13, and the inside of the peripheral wall 3 during pressurization of one or both pressure chamber (s) 14, 15 of each hydraulic working space 8 of the appliance 1, the vanes 13 of the impeller 10 are, in accordance with the invention, additionally configured with pressure balance means with which the hydraulic fluid pressure in the pressurized pressure chambers 14, 15, which acts on the outer end surface 18 of the vanes 33, is also transmitted to the inner end surface 16 of the vanes 13. It may be seen from FIGS. 3 and 4 that these pressure balance means are respectively configured on the vanes 13 of the impeller 10 as balance ducts 19, 20 extending from the outer end surface 18 of the vanes 13 to their inner end surface 16.

Figure 3:
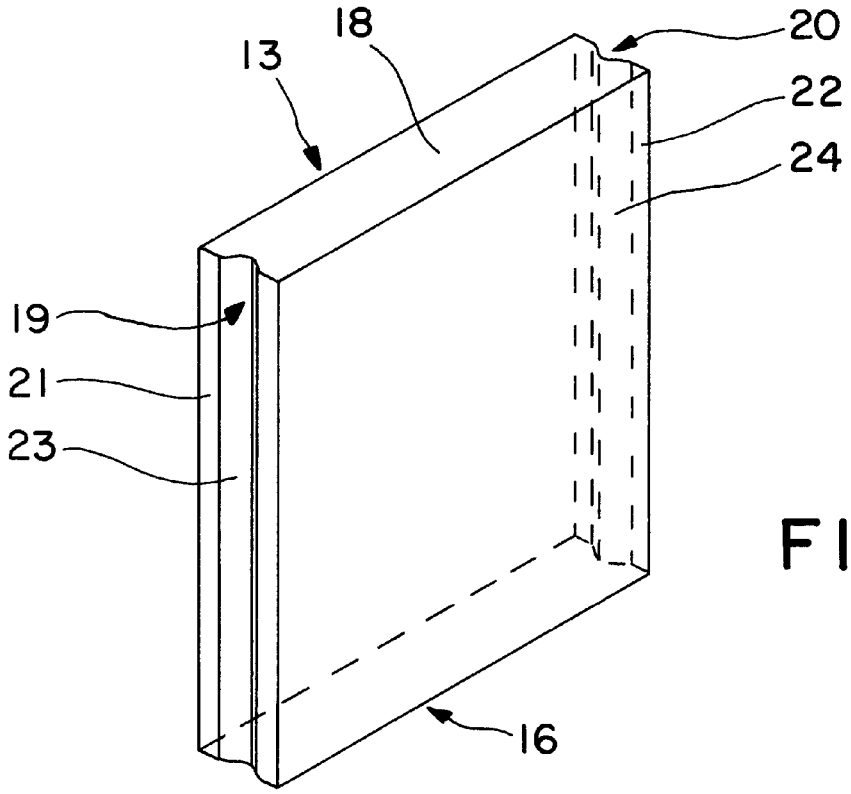
FIG. 3 shows the enlarged three-dimensional view of a first embodiment of a vane of the impeller.

In the first embodiment of a vane 13, configured according to the invention and as shown in FIG. 3, of the impeller 10, these balance ducts 19, 20 are configured as radial grooves 23, 24 which are machined in the side surfaces 21, 22, of the vanes 13, which are in sealing contact with the side walls 4, 5 of the driving wheal 2. It may be clearly seen that these radial grooves 23, 24 are then arranged on the radial longitudinal center lines of the side surfaces 21, 22 of the vanes 13 and have a width corresponding to approximately one third of the vane thickness and a depth corresponding to approximately one quarter of the vane thickness, so that they can provide compensation for the hydraulic fluid leaks between the pressure chambers 14, 15 of each hydraulic working space 8 occurring via the axial retention grooves 12 of the vanes 13.

Figure 4:
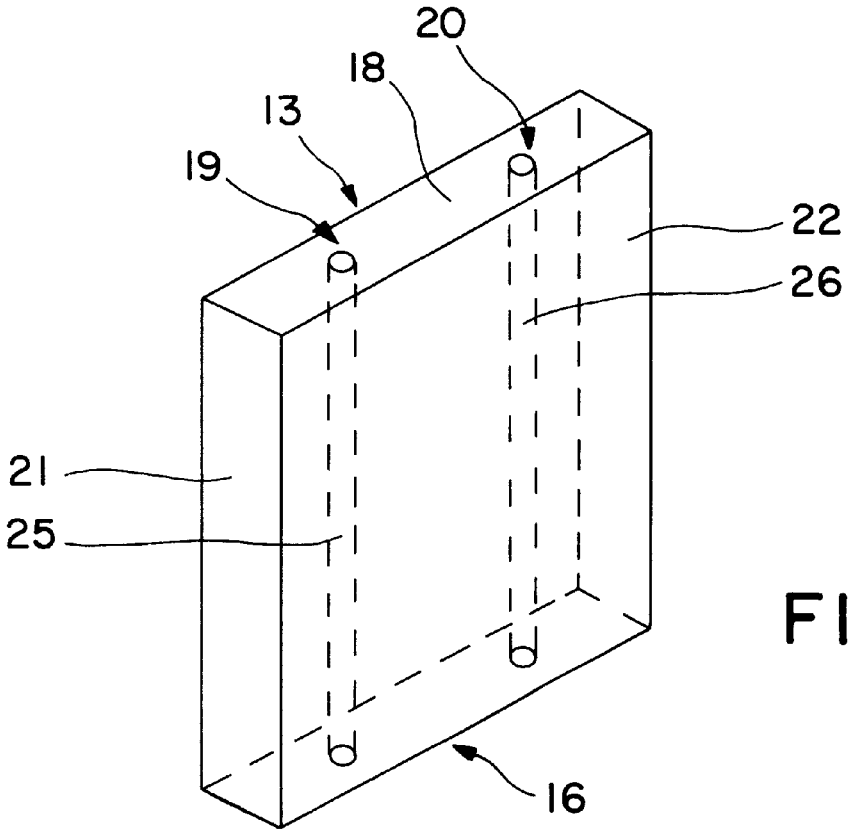
FIG. 4 shows the enlarged three-dimensional view of a second embodiment of a vane of the impeller.

The alternative second embodiment of a vane 13, of the impeller 10, configured according to the invention and as shown in FIG. 4, differs from the first embodiment in that the balance ducts 19, 20 are configured as two radial holes 25, 26, which extend through the vanes 13 at right angles to their end surfaces, 16, 18 and are arranged symmetrically relative to one another. As is indicated in the drawing, these radial holes 25, 26 are arranged on the axial longitudinal center line of the outer end surfaces 18 of the vanes 13 and have, to provide compensation for the hydraulic fluid leaks between the pressure chambers 14, 15 of the hydraulic working spaces 8 occurring via the axial retention grooves 12 of the vanes 13, a diameter, corresponding to approximately one quarter of the vane thickness.

What is claimed is:

1. Appliance for modifying the timing of gas-exchange valves of an internal combustion engine, including a hydraulic camshaft adjustment device comprising a driving wheel (2) which is configured as an external rotor, which is in drive connection with a crankshaft of the internal combustion engine and has a hollow space (6) formed by a hollow-cylindrical peripheral wall (3) and two side walls (4, 5), at least one hydraulic working space (8) is formed in the hollow space (6) of the driving wheel (2) by at least two boundary walls (7) extending from the inside of the peripheral wall (3) and directed toward the longitudinal center line of the driving wheel (2), an impeller (10) which is configured as an internal rotor, is torsionally connected to a camshaft (9) of the internal combustion engine and is inserted in the hollow space (6) of the driving wheel (2), on the periphery of an impeller hub (11), the impeller (10) has at least one vane (13) which is arranged in an axial retention groove (12) and which extends radially in a working space (8) of the driving wheel (2) and subdivides each working space (8) into two oppositely acting hydraulic pressure chambers (14, 15), the outer end surface (18) of each vane (13 of the impeller (10) is in sealing contact with the inside of the peripheral wall (3) of the driving wheel (2) due to the force of a spring element (17) arranged on the inner end surface (16) of the vane in the axial retention groove (12), during pressurization by means of a hydraulic fluid, the pressure chambers (14, 15) cause a pivoting motion or fixed location of the impeller (10) relative to the driving wheel (2) and, therefore, of the camshaft (9) relative to the crankshaft, characterized in that the vanes (13) of the impeller (10) are additionally configured with pressure balance means with which, during pressurization of one or both pressure chambers (14, 15) of each hydraulic working space (8) of the appliance (1), the hydraulic fluid pressure, in the pressurized pressure chambers (14, 15), which acts on the outer end surface (18) of the vanes (13), can also be transmitted to the inner end-surface (16) of the vanes (13).

2. Appliance according to claim 1, characterized in that the pressure balance means on the vanes (13) of the impeller (10) are configured as balance ducts (19, 20) extending in each case from the outer end surface (18) of the vanes (13) to their inner end surface (16).

3. Appliance according to claim 2, characterized in that the radial grooves (19, 20) are configured as radial grooves (23, 24) machined into the side surfaces (21, 22), which are in sealing contact with the side walls (4, 5) of the driving wheel (2), of the vanes (13).

4. Appliance according to claim 3, characterized in that the radial grooves (23, 24) are arranged on the radial longitudinal center lines of the side surfaces (21, 22) of the vanes (13) and have a width corresponding to approximately one third of the vane thickness and a depth corresponding to approximately one quarter of the vane thickness.

5. Appliance according to claim 2, characterized in that the balance ducts (19, 20) are configured as two radial holes (25, 26) which extend through the vanes (13) at right angles to their end surfaces (16, 18) and are arranged symmetrically relative to one another.

6. Appliance according to claim 5, characterized in that the radial holes (25, 26) are arranged on the axial longitudinal center line of the outer end surfaces (18) of the vanes (13) and have a diameter corresponding to approximately one quarter of the vane thickness.

* * * * *